US007005990B1

(12) United States Patent
Rocci

(10) Patent No.: US 7,005,990 B1
(45) Date of Patent: Feb. 28, 2006

(54) MOTION DETECTOR AND ADAPTER THEREFOR

(76) Inventor: Steven J. Rocci, 111 Ogden Ave., Swarthmore, PA (US) 19081

( * ) Notice: Subject to any disclaimer, the term of this patent is extended or adjusted under 35 U.S.C. 154(b) by 0 days.

(21) Appl. No.: 10/613,699

(22) Filed: Jul. 3, 2003

Related U.S. Application Data

(63) Continuation-in-part of application No. 09/939,987, filed on Aug. 27, 2001, now Pat. No. 6,661,343.

(51) Int. Cl.
*G08B 23/00* (2006.01)

(52) U.S. Cl. ..... 340/573.1; 340/541; 340/565

(58) Field of Classification Search ..... 340/573.1, 340/541, 565, 573.4, 825.32, 539.1, 505; 348/152, 155
See application file for complete search history.

(56) References Cited

U.S. PATENT DOCUMENTS

| | | | | |
|---|---|---|---|---|
| 3,891,980 | A * | 6/1975 | Lewis et al. | 340/5.62 |
| 5,053,774 | A | 10/1991 | Schuermann et al. | 342/44 |
| 5,351,052 | A | 9/1994 | D'Hont et al. | 342/42 |
| 5,453,747 | A | 9/1995 | D'Hont et al. | 342/42 |
| 5,605,182 | A | 2/1997 | Oberrecht et al. | 141/94 |
| 5,689,242 | A | 11/1997 | Sims et al. | 340/652 |
| 5,708,273 | A * | 1/1998 | VonBargen | 250/341.2 |
| 5,745,849 | A | 4/1998 | Britton | 455/404 |
| 5,955,951 | A | 9/1999 | Wischerop et al. | 340/572.8 |
| 5,969,595 | A | 10/1999 | Schipper et al. | 340/426 |
| 6,026,868 | A | 2/2000 | Johnson, Jr. | 141/94 |
| 6,057,764 | A | 5/2000 | Williams | 340/572.1 |
| 6,061,552 | A | 5/2000 | Cerasini et al. | 455/128 |
| 6,084,517 | A | 7/2000 | Rabanne et al. | 340/573.4 |
| 6,218,941 | B1 | 4/2001 | Cromer et al. | 340/572.1 |
| 6,236,314 | B1 | 5/2001 | Smith et al. | 340/572.7 |
| 6,236,335 | B1 | 5/2001 | Goodwin, III | 340/825.49 |
| 6,297,739 | B1 * | 10/2001 | Small | 340/573.3 |
| 6,411,209 | B1 * | 6/2002 | Lyons et al. | 340/541 |

* cited by examiner

*Primary Examiner*—Phung T. Nguyen
(74) *Attorney, Agent, or Firm*—Steven J. Rocci

(57) ABSTRACT

An object that can be sensed by a motion detector is equipped with a small, battery powered transponder. A motion detector has (either internally or externally) a transceiver adapted to provide a query signal. If the object is within range of the query signal, the transponder responds with a transponder signal. The transceiver is responsive to receipt of the transponder signal to prevent the detection of motion from causing an alarm.

34 Claims, 9 Drawing Sheets

MOTION DETECTOR AND ADAPTER THEREFOR

RELATED APPLICATION DATA

This is a continuation-in-part of U.S. patent application Ser. No. 09/939,987 filed Aug. 27, 2001, now U.S. Pat. No. 6,661,343, the entirety of which is incorporated herein by reference.

FIELD OF THE TECHNOLOGY

The present invention relates generally to security systems and particularly to motion detectors for security systems, such as passive infrared (IR) detectors.

BACKGROUND OF THE TECHNOLOGY

Motion detectors for security systems are well known. The most common type of motion detector is a passive IR detector that detects motion from animate, moving objects that emit IR, such as humans and animals. (The terms "object" and "objects" as used herein include animals and humans.) Passive IR motion detectors are usually designed to provide an indication ("breach indication") to an alarm panel (or wirelessly to a receiver in communication with the alarm panel) in response to detecting IR that is indicative of motion of the object (e.g., by integrating the detected IR, or by otherwise processing the detected IR, to make a determination that the detected IR is indicative of motion). The alarm panel is responsive to receipt of the breach indication to cause an alarm condition to occur.

Animals, and especially cats, pose special problems for environments employing security systems with motion detectors because they are usually free to roam spaces in which motion detectors are employed ("protected space") and hence, when the security system has been armed, they can set off an alarm when they enter the protected space. Although the protected spaces are usually zoned and specific zones can usually be bypassed at the alarm panel, this defeats the purpose of installing the motion detector in the protected space in the first instance.

Humans also pose a problem because they might forget that the protected space has been armed with a motion detector and wonder into it. Again, though protected spaces can usually be bypassed, bypassing defeats the purpose of the alarm system, and also humans can forget to bypass the protected zones when they arm the system. In addition, particularly in commercial and industrial establishments, the security system must be disabled, or appropriate zones must be bypassed at the alarm panel, to enable cleaning and maintenance crews, and the like, to work in a protected space. This again may defeat the purpose of the alarm system, and may also suffer from the disadvantage that the alarm disabling or bypass codes may need to be provided to the crews (or others) so that they can disable the alarm system or bypass the zone(s) while they work. This increases the chances that the codes will fall into the wrong hands and subsequently be used for illicit purposes.

It is desirable to provide a means by which protected spaces can remain armed and protected by motion detectors, but which allows authorized objects to roam within those spaces without setting off the alarm.

The present invention achieves this goal.

SUMMARY OF THE PREFERRED EMBODIMENTS

An object that can be sensed by a motion detector is equipped with a small, battery powered device, such as a transmitter, that can transmit an authorization signal. A motion detector is equipped with (either internally or externally, and/or integrally, or by way of an adapter), or otherwise associated with, a receiver capable of receiving the authorization signal. Receipt of the authorization signal by the receiver either prevents the motion detector from sensing IR (and hence prevents the detection of motion and the generation of a breach indication by the motion detector), prevents the detection of motion, prevents the generation of a breach indication by the motion detector, or prevents the motion detector from providing the breach indication from causing an alarm (e.g., by preventing the breach indication from reaching the alarm panel). All of the foregoing represent a form of preventing the motion detector from providing the breach indication.

Alternatively, a first transceiver, instead of merely a receiver, is associated with the motion detector, and the object is equipped with a second transceiver, such as transponder, instead of merely a transmitter. The first transceiver is capable of providing a query signal either in response to the detection of motion from the motion detector, or in response to the detection of IR from an IR sensor (that detects merely the presence of IR before the motion detector can sense the presence of IR indicative of motion). The second transceiver responds to receipt of the query signal by transmitting the authorization signal. Receipt of the authorization signal by the first transceiver either prevents the motion detector from sensing IR, prevents the generation of a breach indication by the motion detector, or prevents the breach indication generated by the motion detector from causing an alarm.

According to one embodiment, the receiver or first transceiver is embodied as an adapter that can be fitted to an existing commercially available motion detector, and/or that can be fitted thereto after the motion detector has already been installed in the protected space. The adapter may comprise a module that communicates between the motion detector and the alarm panel (or, in the case of a wireless motion detector, communicates between the motion detector and the receiver that normally receives the wirelessly transmitted breach indication) that either prevents the generation of a breach indication by the motion detector or that prevents the breach indication generated by the motion detector from causing an alarm (e.g., by preventing the breach indication from reaching the alarm panel).

The adapter may comprise a normally open shutter that is sized and/or adapted to be mounted over the sensing window of the motion detector and that is wired to, or otherwise communicates with, the module containing the receiver or first transceiver. The shutter closes in response to receipt of the authorization signal so as to substantially block the passage of IR to the sensing window, and hence prevents the motion sensor from detecting motion. In another embodiment, the first transceiver transmits a query signal in response to the detection of IR from the IR sensor, and the second transceiver responds to receipt of the query signal by transmitting the authorization signal. The shutter may comprise a mechanical shutter or a liquid crystal material.

DETAILED DESCRIPTION OF THE FIGURES

DETAILED DESCRIPTION OF THE PREFERRED EMBODIMENTS

The present invention is described herein in the context of the presently preferred embodiments, but is not limited thereto except as set forth in the appended claims.

Figure 1:
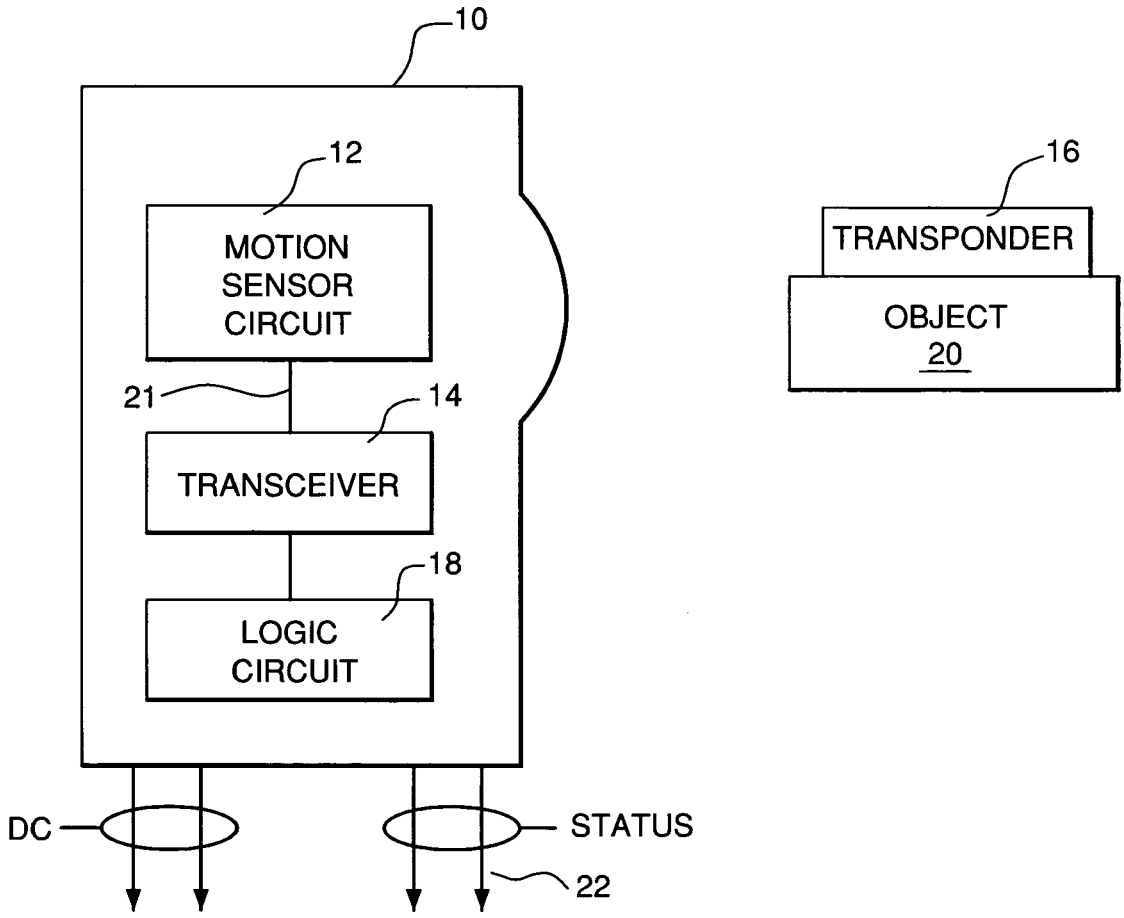
FIG. 1 is a block diagram illustrating a motion detector according to one embodiment of the present invention.

Referring to FIG. 1, there is shown a motion detector 10 having a processing circuit (motion sensing) 12 therein in well known fashion. Motion detector 10 may be a commercially available passive IR motion detector, such as the model DS774Ti (www.detectionsys.com) or DS820I manufactured by Detection Systems Inc., Fairport, N.Y. As is well known, many motion detectors 10 operate using 4 wires, two of which deliver DC power to the device, and the other two of which report status (the breach indication) to an alarm panel 30 (e.g., relay contact closure upon detection of motion, 4–20 mA loop, etc.). Wireless passive IR detectors are also known, and an embodiment of the present invention is described herein in connection with such wireless devices. As is known, the motion detector communicates with an alarm panel that sounds an alarm if motion detector 10 reports motion by providing the breach indication (sometimes also referred to herein as an "alarm signal") over the status lines 22. In the case of wireless passive IR detectors, the motion detector communicates a breach indication to the alarm panel by means of a receiver that receives the wireless breach indication transmitted from the motion detector and, usually, provides a hard wired alarm signal to the alarm panel 30.

In accordance with the invention, motion detector 10 is modified, equipped and/or fitted with a first transceiver 14 that cooperates with a second, compact, battery powered transceiver 16. Transceiver 16 is preferably a transponder. Examples of transceivers 14 and transponders 16, and systems suitable for the present invention, are described in U.S. Pat. Nos. 5,351,052; 5,453,747 and 5,053,774, and also in U.S. Pat. Nos. 6,236,314; 6,026,868 and 5,605,182, all of which are incorporated herein by reference. Commercial implementations of such devices can be found in so-called "Easy Pass" traffic/toll systems and in the Mobil Speed Pass system promoted by Mobil Oil Corporation (www.speedpass.com). As is well known, such transponders are essentially a transceiver that automatically responds to receipt of an appropriate signal by transmitting its own signal to, e.g., identify itself or its presence. The term "authorization signal" is used herein to refer to the signal transmitted from the transponder 16 and the term "query signal" is used to refer to the signal to which the transponder is responsive to transmit the authorization signal. Both the query signal and the authorization signal may transmit on a unique frequency and/or using a unique code.

Motion detector 10 is also modified, equipped and/or fitted with logic circuitry 18, such as digital or analog logic circuitry. According to the invention, a transceiver/transponder 16 is placed on or worn by an object 20 that may enter the protected space. According to one embodiment of the invention, transceiver 14 transmits a query signal only in response to an indication of motion from the processing circuitry 12 (shown on line 21). If the transceiver/transponder responds with an authorization signal, then logic circuitry 18 prevents the breach indication, that would normally cause the alarm panel to generate an alarm, from doing so, e.g., by preventing generation of the breach indication or by preventing the breach indication from being sent to the alarm panel over status lines 22. See FIG. 5. Otherwise, the breach indication is provided to the alarm panel. It may be desirable to adjust the transceiver 14 and transceiver/transponder 16 so that their effective transmission/reception reception ranges are no greater than the detection range of motion detector 10 and/or of the area of the protected space.

In alternative embodiments, transceiver 14 transmits query signals at periodic intervals, or transmits query signals constantly, rather than in response to an indication of motion. See FIG. 6. In other alternative embodiments, the object is equipped with merely a transmitter (rather than a transceiver or transponder) that constantly or periodically transmits the authorization signal, such that the transmission of query signals is not required. In such case, the motion detector need merely be equipped with merely a receiver, rather than a transceiver 14, to receive the authorization signal and to prevent the generation of the breach indication, or to prevent the breach indication from being provided to the alarm panel, in response thereto.

Figure 2:
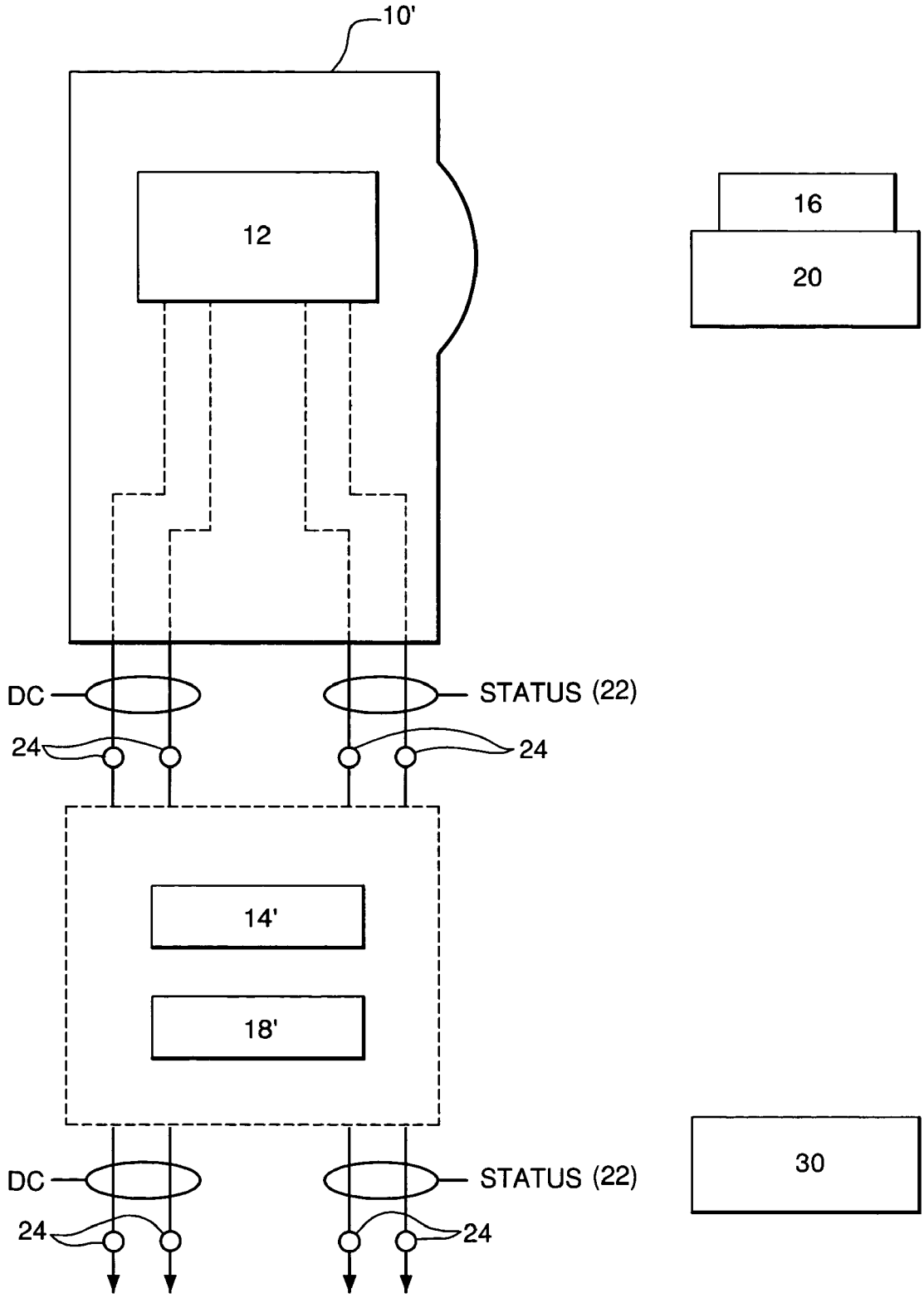
FIG. 2 is a block diagram illustrating a motion detector and an adapter therefore according to another embodiment of the present invention.

FIG. 2 illustrates an embodiment of the invention which does not require modification of a commercially available motion detector 10'. In this embodiment, the invention is provided as an adapter or retrofit device 15 that can be externally connected to the motion detector 10'. Particularly, the transceiver 14' and logic circuitry 18' receive the status lines 22 (and DC power) externally to the motion detector 10'. This can be accomplished by a simple plug and receptacle arrangement, shown by the circles 24. The transceiver 14' and logic circuitry 18' may be contained in the same or separate housings. The operation is as described above. The adapter may be disposed within a module that can be attached on or near the motion detector, e.g., by tape, hook and latch fasteners (such as Velcro®), an adhesive, or other means.

Figure 3:
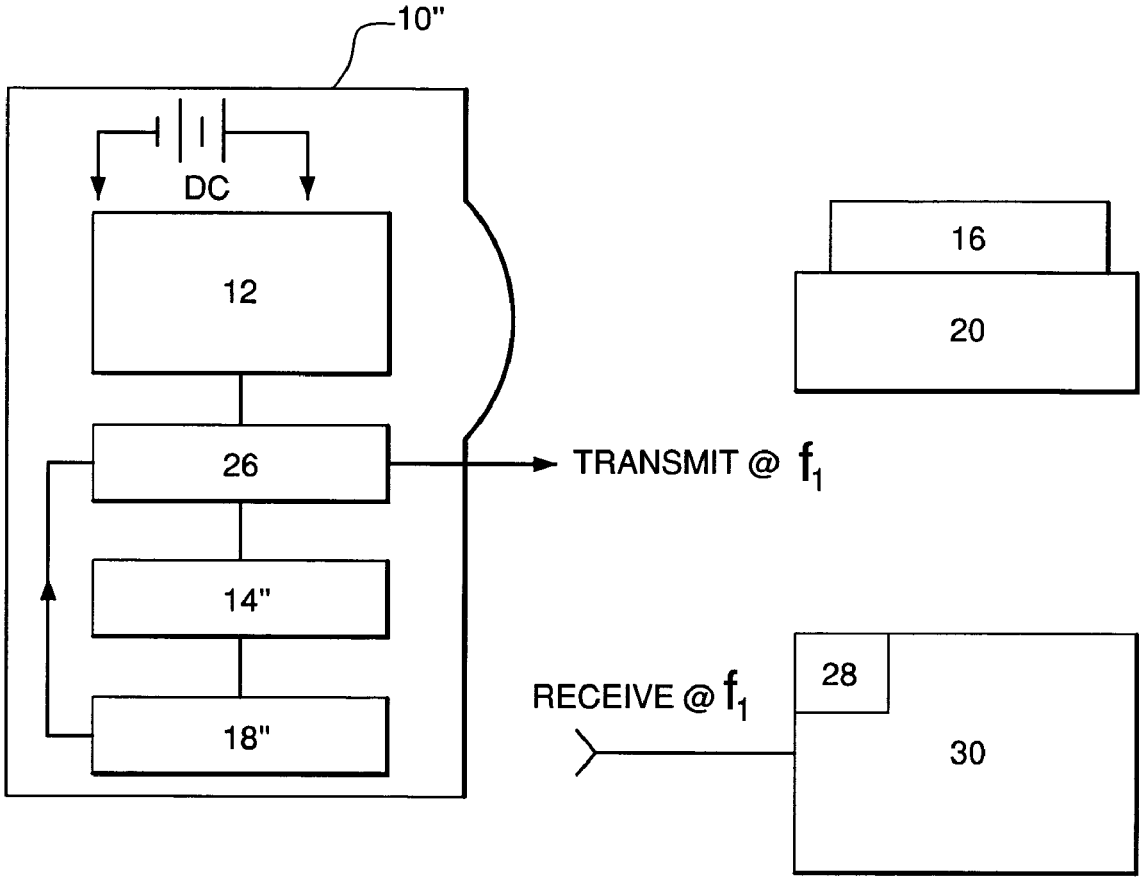
FIG. 3 is a block diagram illustrating a wireless motion detector according to one embodiment of the present invention.
Figure 5:
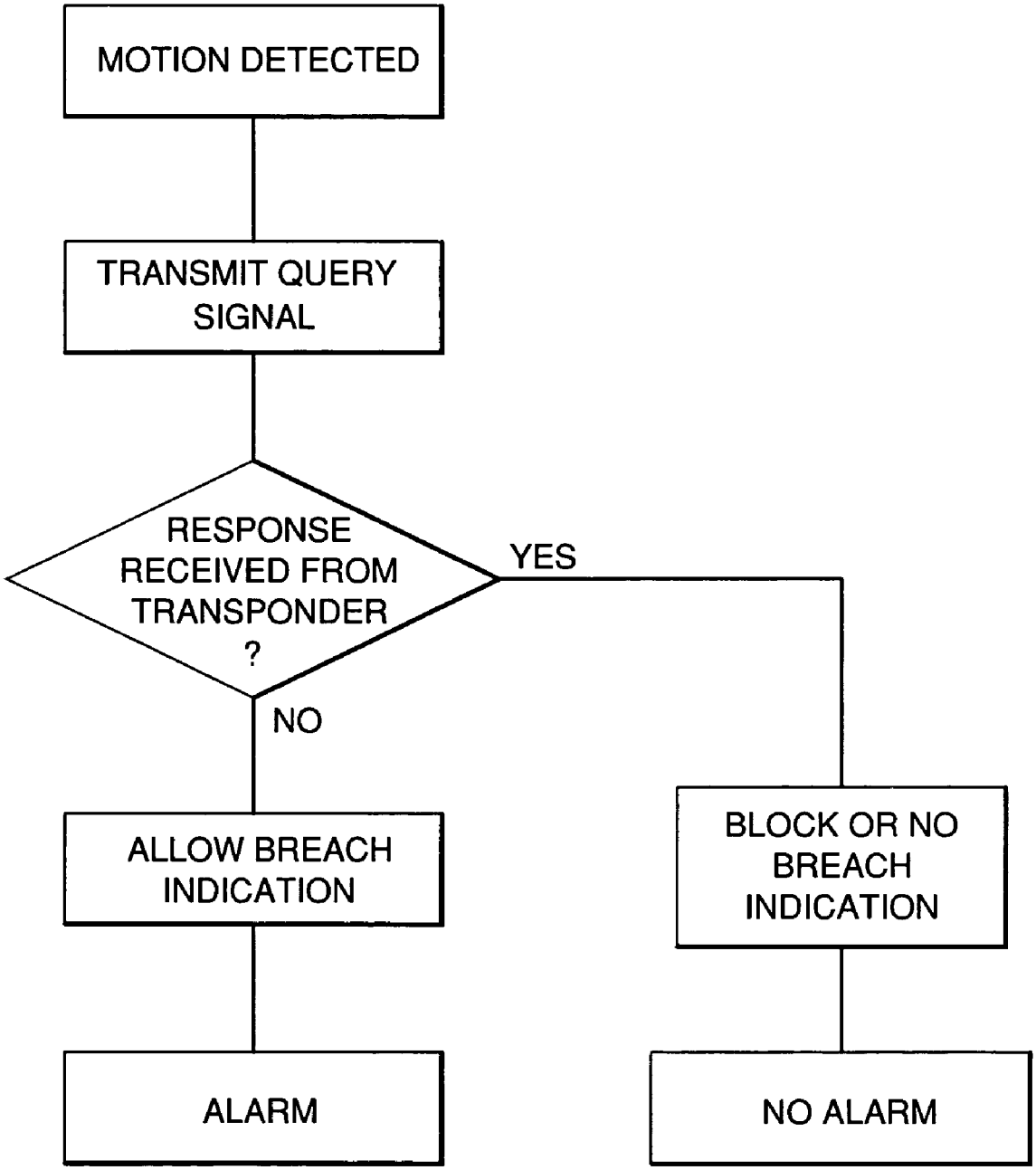
FIG. 5 is a flow diagram illustrating the operation of the devices of FIGS. 1–4 according to one method of the invention.
Figure 6:
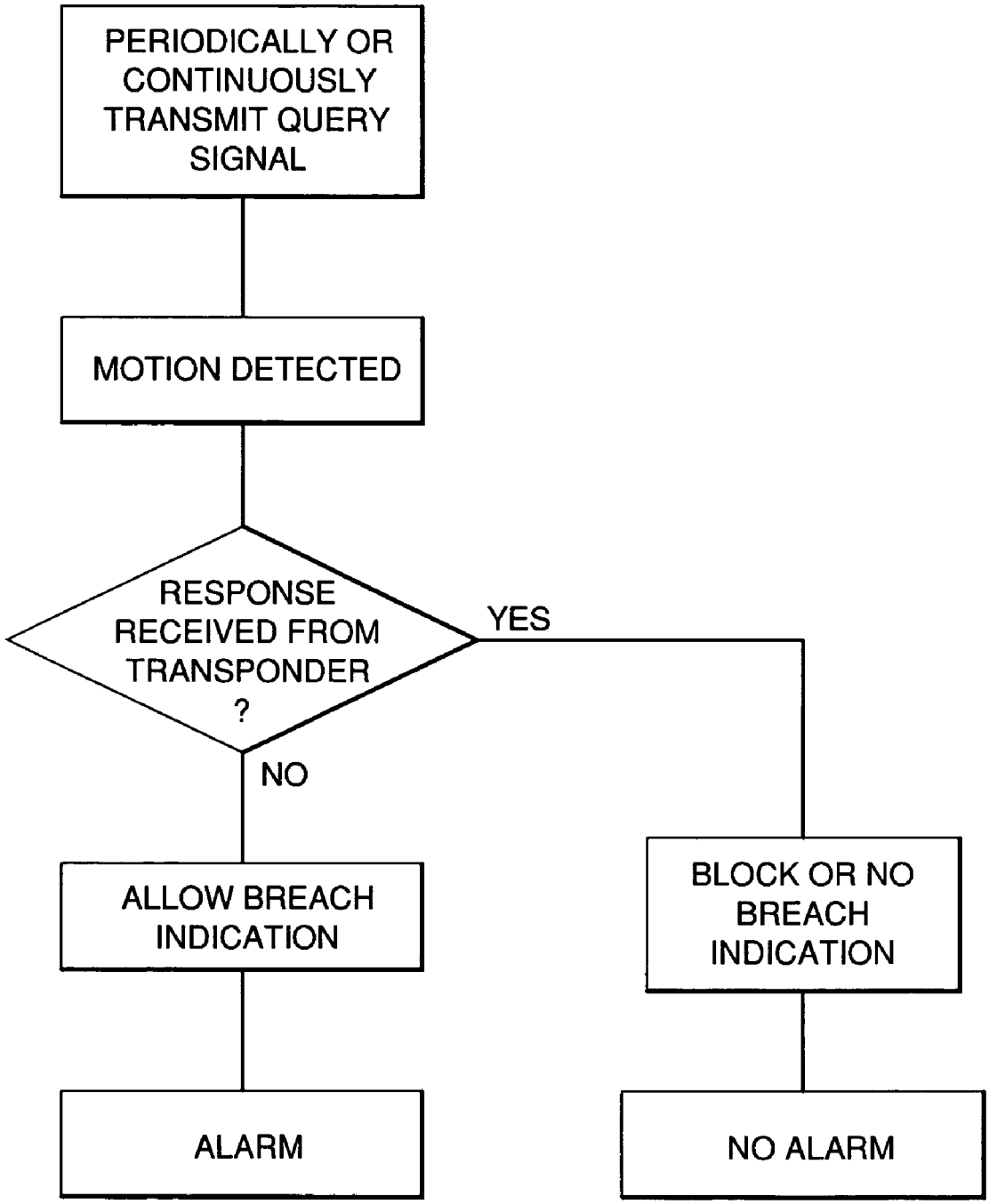
FIG. 6 is a flow diagram illustrating the operation of the devices of FIGS. 1–4 according to another method of the invention.

FIG. 3 illustrates a commercially available wireless motion detector 10" that, instead of employing status lines 22, has a built in (or external) radio transmitter 26 that is tuned to transmit a breach indication at frequency f1 in response to the detection of motion. Receiver 28 in communication with the alarm panel 30 is likewise tuned to receive at frequency f1. If receiver 28 receives a transmitted breach indication, receiver 28 communicates this to the alarm panel 30 which causes an alarm condition. (As is known, the transmitted breach indications may be coded for indication of the zone in which the breach occurred.) As in the embodiment of FIG. 1, the motion detector 10" is modified to incorporate a transceiver 14" for communicating with a transceiver 16, and logic circuitry 18". Logic circuitry 18" prevents the generation of a breach indication or prevents the transmitter 26 from transmitting a breach indication to the receiver 28, if, as indicated in FIGS. 5 and 6, an authorization signal is received in response to a query signal. Otherwise, the breach indication is transmitted.

Figure 4:
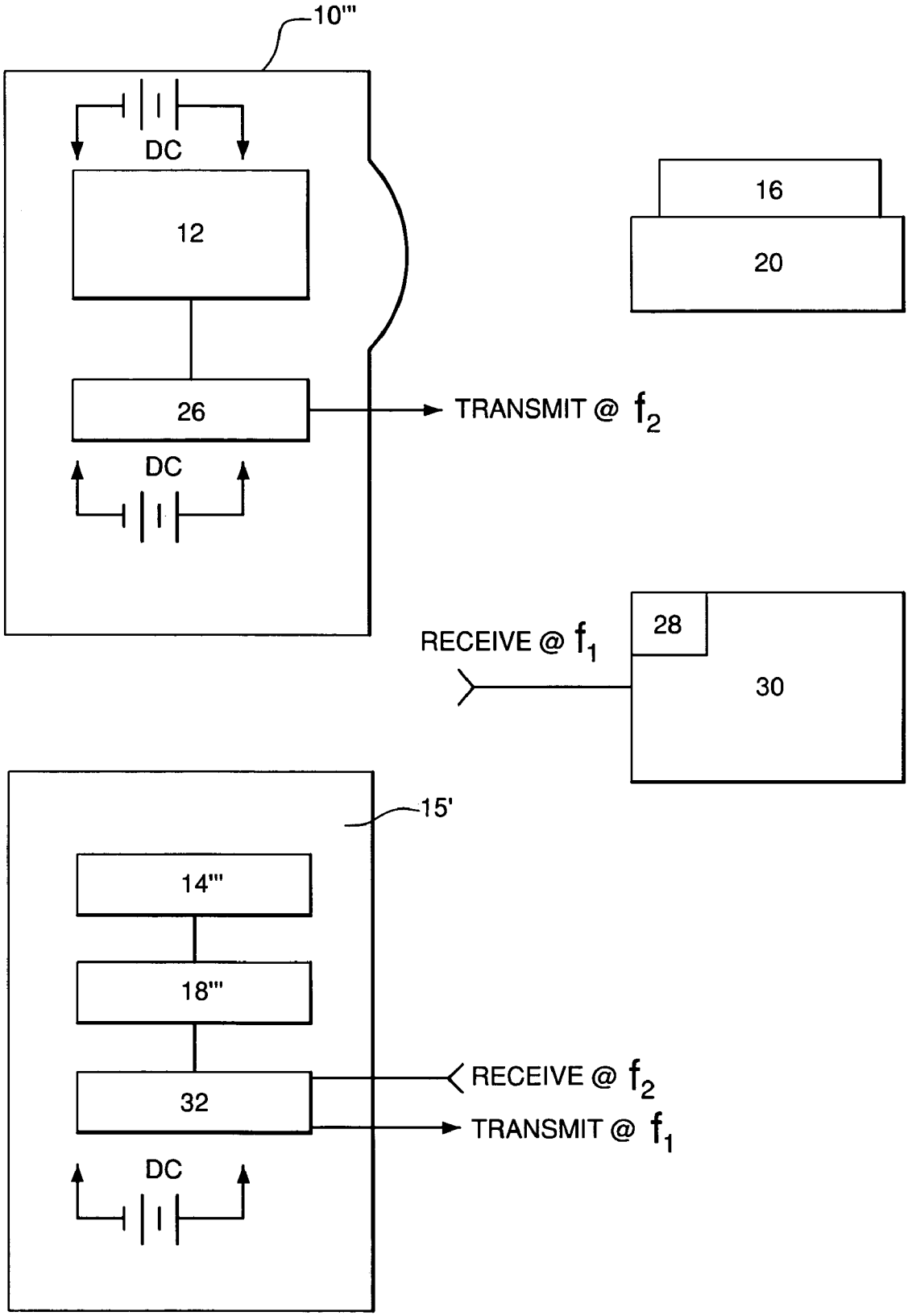
FIG. 4 is a block diagram illustrating a wireless motion detector and an adapter therefore according to another embodiment of the present invention.

The embodiment of FIG. 4 illustrates the use of an external adapter 15' for a wireless motion detector 10'" that may not require modification of the circuitry of commercially available motion detector 10'". The adapter 15' contains a transceiver 14'", logic circuitry 18'" and another transceiver 32. In this embodiment, the transmitter 26 is tuned to transmit a different frequency, f2, than the frequency f1 that the receiver 28 in communication with the alarm panel 30 is tuned to receive. Transceiver 32 is tuned to receive at f2 and transmit at f1. The adapter receives the transmitted breach indication (transmitted at f2) and retransmits the breach indication at f1 only if no authorization signal is received by transceiver 14'" in response to a query signal.

An example of a wireless motion detector 10" that may be modified as above described, or that may be employed with an adapter 15' as above described, is the Dimango® model RC2070 motion detector available from Lord Henry Enterprises, 5903 Port Andarko Trail, Hermitage, Tenn. 37076 (www.dimango.com). As shown, the wireless motion detectors 10" and 10'" may be battery powered.

In the wireless embodiments, the transceiver 14" and the transceiver 16 may be replaced with a receiver and a transmitter, respectively, as described above in connection with the hard wired embodiments.

In the above embodiments, logic circuitry 18, 18' and/or adapter 15, 15' prevent the generation of the breach indication in response to detection of motion, and/or prevent the breach indication from being provided to the alarm panel, in response to receipt of the authorization signal. FIGS. 7–11 are directed to an embodiment of the invention that prevents the motion detector 10 from detecting motion when an authorization signal has been received from a transmitter or transceiver 16 worn by an object 20. This embodiment takes advantage of a characteristic of most modern day passive IR motion detectors, that is, that they do not provide a breach indication merely in response to detecting the presence of IR, but rather that they process the detected IR over time in some manner so as to make a determination that the detected IR is indicative of motion. As a result, modern day passive IR exhibit a delay between the time that they first detect IR and the time that they make a determination that the IR indicates motion in the protected space. Hence, the breach indication is provided only after the motion determination has been made.

The embodiment of FIGS. 7–11 employs a normally open shutter 34 that can be disposed over the sensing window 36 of the motion detector 10, and that closes in response to receipt of the authorization signal 42 to prevent any substantial IR 38 from the object 20 from passing there-through to the sensing window 36 or to the motion sensing circuitry 12 in the motion detector 10. In the embodiment of FIGS. 7–11, the motion detector 10 may again be any commercially available passive IR motion detector. However, the embodiment of FIGS. 7–11 requires no modification to the motion detector itself, or to the wiring of the motion detector to the alarm panel (as in the embodiment of FIGS. 1 and 2), or to the RF circuitry of a wireless motion detector (as in the embodiment of FIGS. 3 and 4). Because the authorization signal 42 is RF, the shutter 34 can be caused to be closed in response thereto before the processing circuitry 12 has processed sufficient IR to make a determination of motion and hence before it provides a breach indication. Closing the shutter 34 prevents the processing circuitry 12 from receiving and hence processing further IR, such that no determination of motion, and hence no breach indication, can be provided as long as the shutter remains closed.

Figure 7:
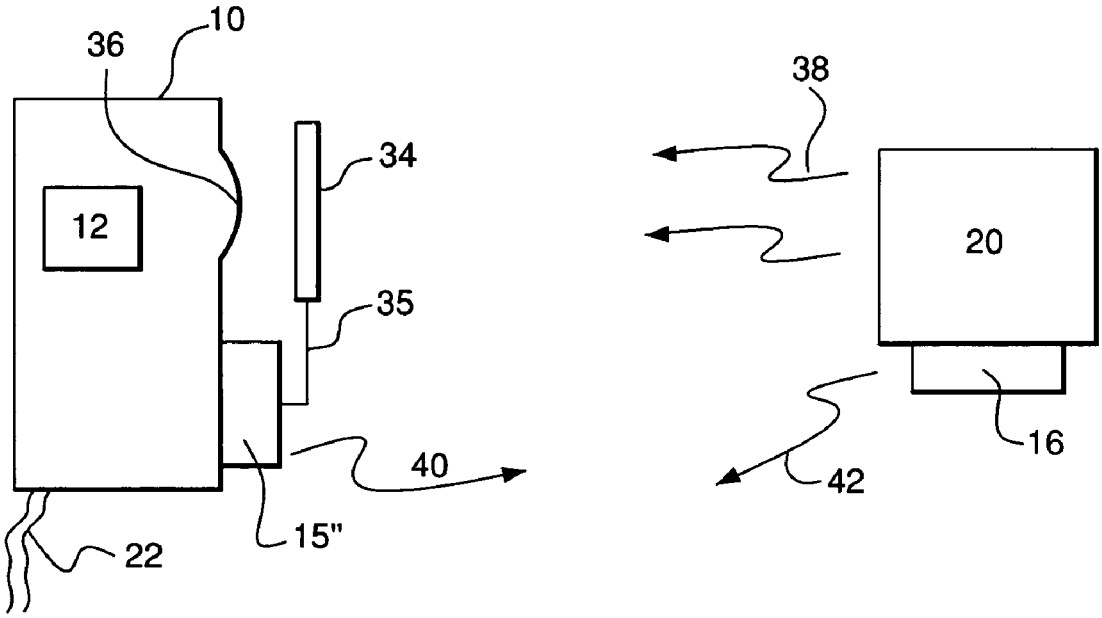
FIG. 7 is a block diagram illustrating a motion detector and an adapter therefore, including a shutter, according to yet another embodiment of the invention.

As shown in FIG. 7, a shutter 34 is disposed over the sensing window 36 of motion detector 10. The shutter is normally open so as to permit IR 38 from an object 20 to pass there-through. The shutter 34 may be any suitable device that is capable of being quickly closed so as to prevent processing circuitry 12 from detecting any motion of object 20, by preventing any substantial IR from object 20 from passing through the motion detector's sensing window 36. The shutter may be a fast acting mechanical shutter, or more preferably, is a liquid crystal film that allows passage of IR there-through when in one state (e.g., inactive or relaxed state) and prevents substantial passage of IR there-through when in another state (e.g., a light retarding or active state). Such liquid crystal film materials are well known. For example, the nematic liquid crystal retarder material used in the Meadowlark Optics' ShapeShifter™ Spatial Light Modulator (www.meadowlark.com/catalog/SLMs/slml.htm) or its functional equivalent may be employed. A flexible and resilient a shutter, constructed, e.g., of a liquid crystal material that is bendable and that will easily conform to the profile of the sensing window 36, may also be employed. An adhesive material, tape, hook and latch fastener (such as Velcro®), or other fastening material, may be employed to affix the shutter to the body of the motion detector 10 over the sensing window 36.

The shutter 34 is preferably disposed over the sensing window 36 in such a manner so as to prevent any substantial IR leakage into the sensing window when the shutter is closed. In the case of a liquid crystal material shutter, this can be easily accomplished by forming the film to the shape of the sensing window, and/or using the fastening material (or other material such as foam), to prevent leakage there-around.

An adapter 15" housed in a module or other housing contains circuitry that is coupled to control the shutter via a line 35. The adapter 15" causes the shutter 34 to close in response to receipt of an authorization signal 42, but otherwise the shutter remains open. The adapter 15" may also be affixed to the body of motion detector 10 (as shown), or adjacent to or remote from the motion detector. Suitable means such as adhesive, tape or a hook and latch fastener may be employed to affix the adapter where desired.

The adapter 15" also contains the circuitry required to communicate with and/or receive communications from, the transmitter/transceiver/transponder 16 worn by object 20. In one embodiment, the device 16 is a transmitter that periodically transmits the authorization signal 42, and the circuitry in the adapter is responsive to receipt thereof (e.g., by means of a receiver) to close the shutter 34. In the absence of the authorization signal, the shutter remains open. See FIG. 9. In another embodiment, the adapter 15" has a transceiver that periodically transmits a query signal 40, and the device 16 worn by the object 20 is a transceiver/transponder that is responsive to receipt of the query signal to transmit the authorization signal 42. See FIG. 10.

In yet another embodiment, the device 16 is a transceiver/transponder, and the adapter 15" has a transceiver 14(4) that transmits the query signal 40 in response to an indication that IR is present in the protected space, but before the processing circuitry 12 can process the IR and make a determination of motion in the space. Thus, in this embodiment, the query signal is sent substantially immediately in response to detection of any IR in the protected space.

Figure 8:
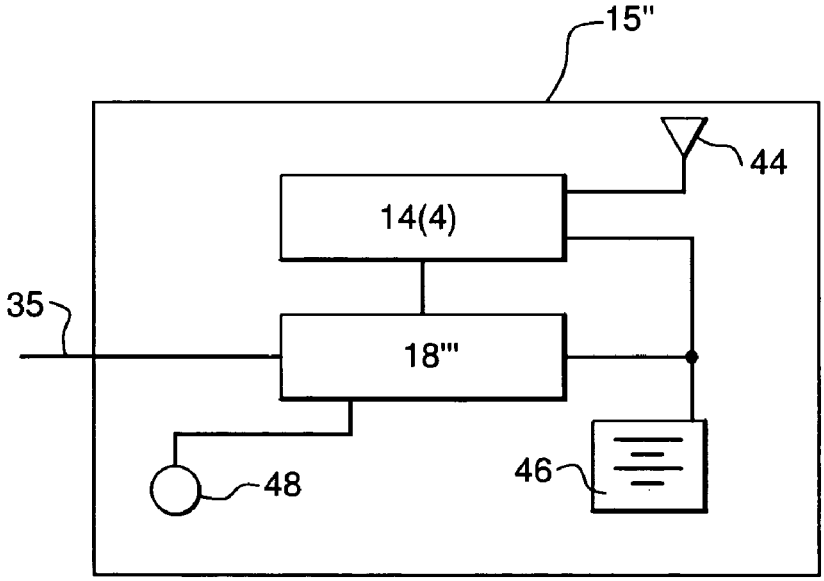
FIG. 8 is a block diagram illustrating details of the adapter of FIG. 7.
Figure 9:
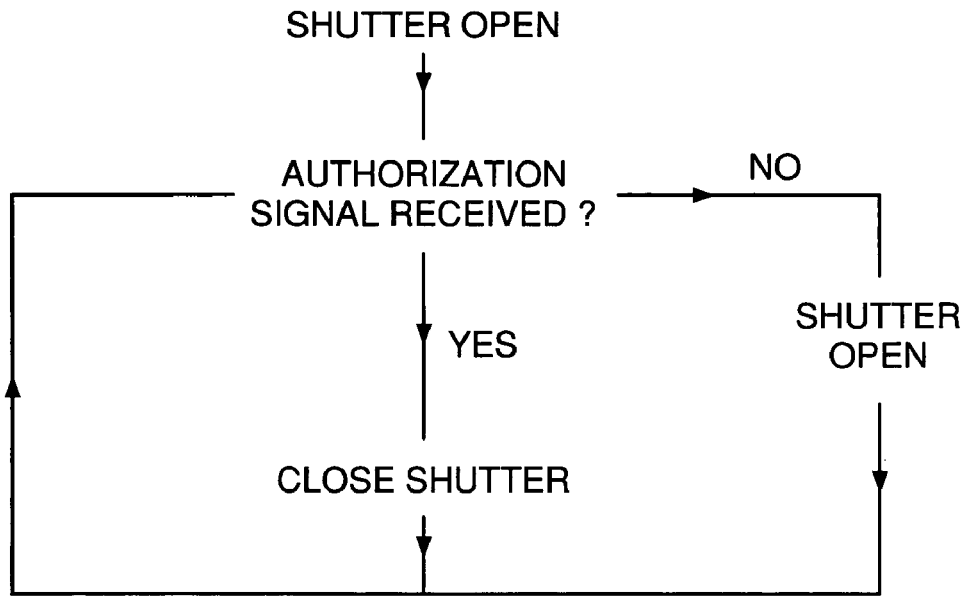
FIG. 9 is a flow diagram illustrating the operation of the adapter of FIG. 7 according to one method of the invention.

Referring to FIG. 8, an IR sensor 48 is provided in the adapter and is disposed, e.g., on a face thereof, such that it can detect the presence of IR in the protected space, or a level of IR indicative of a pet or human). The IR sensor 48 provides a signal to control circuitry 18'" (which may be embodied as analog or digital or logic circuitry) that causes transceiver 14(4) to immediately transmit a query signal 40 (via antenna 44) upon the detection of IR (or upon a selected level of IR). sensor 48 that senses the presence and receives the authorization signal 42 (if generated by device 16 in response to the query signal) is transmitted. FIG. 8 may be used to implement the above. If the authorization signal is received, the control circuitry 18'" causes the shutter 34 to close; otherwise the shutter remains open. See FIG. 11. Preferably, but necessarily, the adapter (and, if needed, the shutter) are powered by a battery 46. If desired, the shutter may be housed in the same housing or module as adapter 15".

Figure 10:
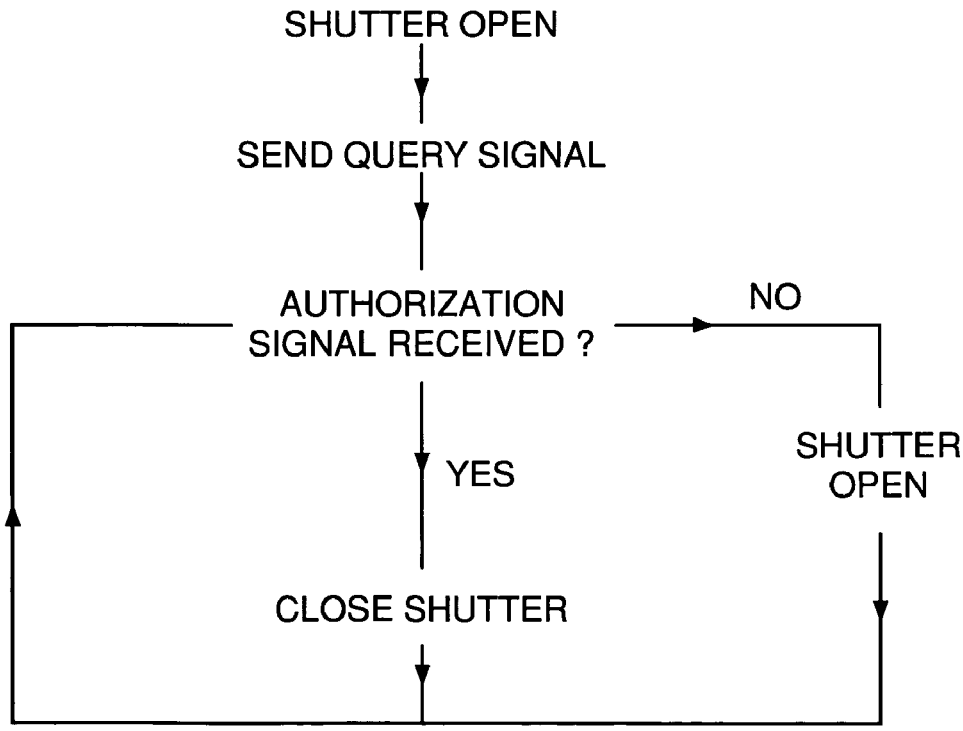
FIG. 10 is a flow diagram illustrating the operation of the adapter of FIG. 7 according to another method of the invention.
Figure 11:
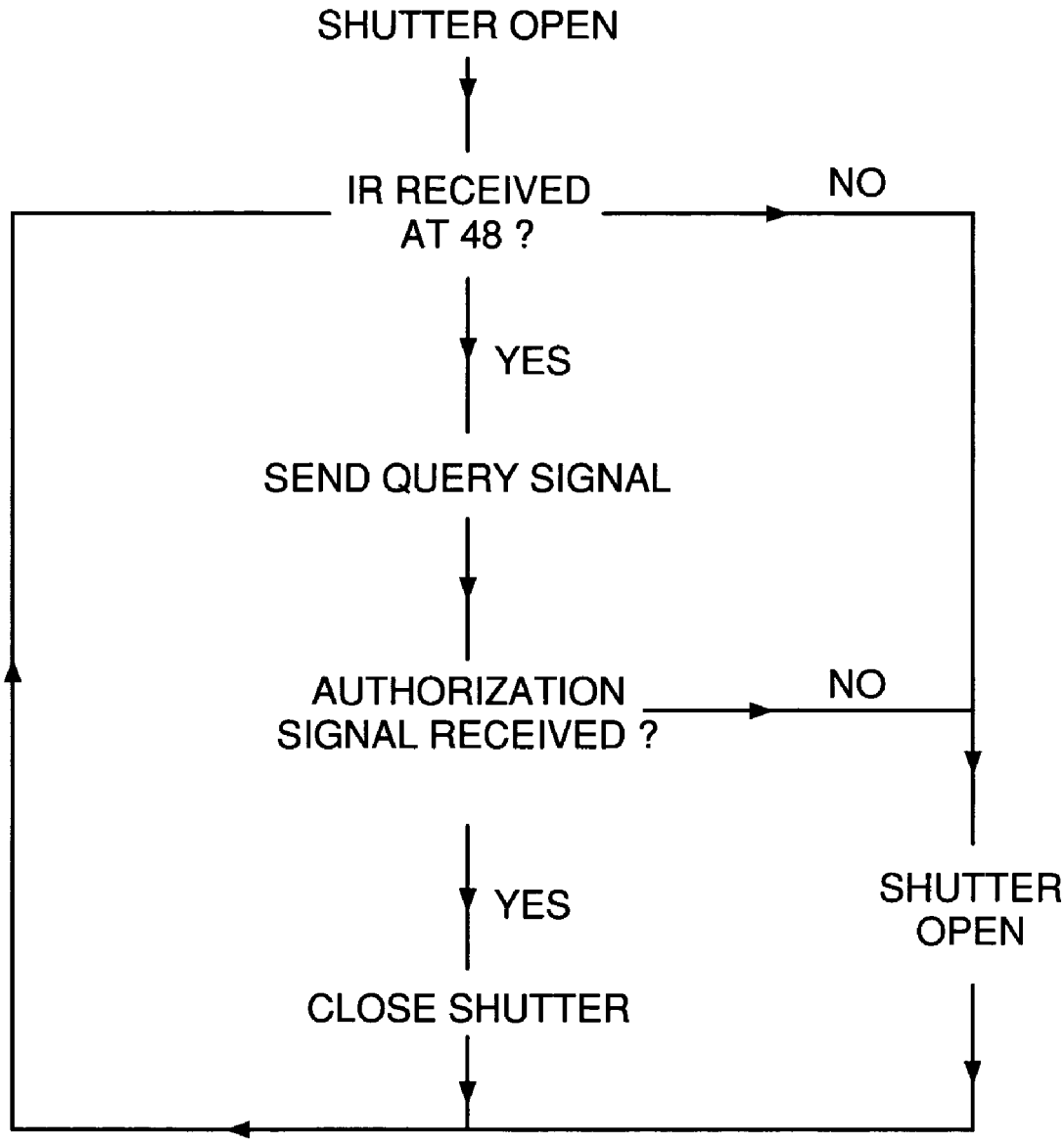
FIG. 11 is a flow diagram illustrating the operation of the adapter of FIG. 7 according to yet another method of the invention.

It will be appreciated that the circuit of FIG. 8 may also readily be adapted to provide the various functionality illustrated in FIGS. 10 and 11. It will also be appreciated that the shutter may be constructed from any suitable material, other than an liquid crystal material, that can be rendered both substantially transparent and opaque to IR radiation, e.g., other types of electronic or solid state shutters. It will be further appreciated that the embodiment of FIGS. 8–11 may be readily employed with wireless motion detectors as well. All of the foregoing is within the scope of the present invention, except as otherwise expressly indicated in the appended claims.

Other embodiments are possible and are within the scope of the invention. Accordingly, resort should be had to the following claims, rather than the foregoing description, to ascertain the scope of the invention.

I claim:

1. A motion detector for placement in a protected space and that normally provides a breach indication in response to a determination of motion in the protected space, comprising:

a) a receiver adapted to provide an indication that an authorization signal has been received from a transmitter; and, b) circuitry responsive to the indication provided by the receiver that prevents the motion detector from providing the breach indication.

2. The motion detector of claim 1 wherein the receiver is embodied as a first transceiver, and the transmitter is embodied as a second transceiver, and the first transceiver periodically transmits a query signal, and the second transceiver is responsive to receipt of the query signal to transmit the authorization signal.

3. The motion detector according to claim 1 wherein the transmitter periodically transmits the authorization signal.

4. The motion detector according to claim 1 wherein the first transceiver transmits a query signal in response to the determination of motion; and the second transceiver transmits the authorization signal in response to receipt of the query signal.

5. The motion detector according to claim 1 wherein the receiver is embodied as a first transceiver, and the transmitter is embodied as a second transceiver, and the first transceiver transmits a query signal in response to the determination of motion, and the second transceiver is responsive to receipt of the query signal to transmit the authorization signal, and the circuitry is responsive to the indication than an authorization signal has been received to prevent the breach indication from being provided to an alarm panel.

6. The motion detector of claim 1 wherein the transmitter is embodied as a transponder adapted to be worn by an object.

7. The motion detector according to claim 1 further comprising a normally open shutter disposed over an infra-red sensing window of the motion detector, and the circuitry closes the shutter in response to the indication provided by the receiver so as to thereafter prevent any substantial infra-red radiation from passing to the sensing window.

8. The motion detector according to claim 1 wherein the receiver defines a first receiver and the motion detector is a wireless motion detector and wherein a wireless breach indication is transmitted to a second receiver in communication with the alarm panel only if no authorization signal has been received by the first receiver.

9. The motion detector according to claim 1 wherein the circuitry prevents the motion detector from providing the breach indication by preventing the motion detector from determining that an object is moving in the protected space.

10. An adapter for motion detector of the type that is placed in a protected space and that normally provides a breach indication to an alarm panel in response to a determination of motion in the protected space, the adapter comprising:

a) a receiver adapted to provide an indication that an authorization signal has been received from a transmitter; and, b) circuitry responsive to the indication provided by the receiver that prevents the breach indication from being provided.

11. The adapter of claim 10 wherein the receiver is embodied as a first transceiver, and the transmitter is embodied as a second transceiver, and the first transceiver periodically transmits a query signal, and the second transceiver is responsive to receipt of the query signal to transmit the authorization signal.

12. The adapter of claim 10 wherein the transmitter periodically transmits the authorization signal.

13. The adapter of claim 10 wherein the first transceiver transmits a query signal in response to the determination of motion; and the second transceiver transmits the authorization signal in response to receipt of the query signal.

14. The adapter of claim 10 wherein the receiver is embodied as a first transceiver, and the transmitter is embodied as a second transceiver, and the first transceiver transmits a query signal in response to the determination of motion, and the second transceiver is responsive to receipt of the query signal to transmit the authorization signal, and the circuitry is responsive to the indication that an authorization signal has been received to prevent the breach indication from being provided to the alarm panel.

15. The adapter of claim 10 wherein the transmitter is embodied as a transponder adapted to be worn by an object.

16. The adapter of claim 10 further comprising a normally open shutter adapted to be disposed over an infra-red sensing window of the motion detector, and the circuitry closes the shutter in response to the indication provided by the receiver so as to thereafter prevent any substantial infra-red radiation from passing to the sensing window.

17. The adapter of claim 16 wherein the shutter is comprised of a liquid crystal material.

18. The adapter of claim 10 wherein the adapter is disposed in a housing adapted to be affixed on or adjacent to the motion detector.

19. The adapter according to claim 10 wherein the motion detector is a wireless motion detector and wherein a wireless breach indication is transmitted to a receiver in communication with an alarm panel only if no authorization signal has been received by the receiver.

20. The motion detector according to claim 10 wherein the circuitry prevents the motion detector from providing the breach indication by preventing the motion detector from determining that an object is moving in the protected space.

21. A system for use with a motion detector comprising:

a) a normally open shutter adapted to be mounted over an infra-red sensing window of the motion detector and that prevents any substantial infra-red radiation from passing there-through to the sensing window when closed; and, b) a housing containing a circuit that closes the shutter in response to receipt of an authorization signal.

22. The system of claim 21 further comprising a transmitter adapted to be worn by an object and that provides the authorization signal.

23. The system of claim 22 wherein the circuit comprises a first transceiver and the transmitter is embodied as a second transceiver, such as transponder, and wherein the first transceiver transmits a query signal and the second transceiver is responsive to receipt of the query signal to transmit the authorization signal.

24. The system of claim 23 wherein the query signal is transmitted in response to detection of infra-red radiation detected by an infra-red sensor disposed in the housing.

25. The system of claim 23 wherein the second transceiver is a transponder.

26. The system of claim 21 wherein the housing is adapted to be affixed on or near the motion detector.

27. The system of claim 21 wherein the shutter comprises a liquid crystal material.

28. An adapter for a motion detector comprising a module containing circuitry that, in response to an authorization signal, prevents the motion detector from providing an indication of motion in a protected space to an alarm panel, the module being mountable on or near the motion detector.

29. The adapter according to claim 28 further comprising a normally open shutter adapted to be mounted over an infra-red sensing window of the motion detector and that prevents any substantial infra-red radiation from passing there-through to the sensing window when closed, and the circuitry closes the shutter in response to receipt of the authorization signal.

30. The adapter of claim 28 wherein the circuitry operates to block any indication of motion provided by the motion detector from being provided to the alarm panel.

31. The adapter of claim 28 wherein the circuitry comprises a first transceiver that transmits a query signal, and the authorization signal is transmitted by a second transceiver, such as a transponder, in response to receipt of the query signal, the second transceiver being adapted to be carried by an object.

32. The adapter of claim 31 wherein the motion detector is a passive infra-red motion detector, and the circuitry comprises an infra-red sensor capable of sensing the presence of infra-red radiation before the infra-red radiation causes the motion detector to provide an indication of motion, and the query signal is transmitted in response to the detection of infra-red radiation by the infra-red sensor.

33. The adapter of claim 31 wherein the second transceiver is a transponder.

34. The adapter according to claim 28 wherein the circuitry is battery powered.

* * * * *